United States Patent [19]

Getz et al.

[11] 4,428,088

[45] Jan. 31, 1984

[54] AUTOMATIC LIQUID LEVEL CONTROL FOR AUTOMATIC WASHERS

[75] Inventors: Edward H. Getz, Pipestone Township, Berrien County; Clarence R. Ott, Jr., Lake Township, Berrien County, both of Mich.

[73] Assignee: Whirlpool Corporation, Benton Harbor, Mich.

[21] Appl. No.: 272,677

[22] Filed: Jun. 11, 1981

[51] Int. Cl.[3] ..... D06F 33/02; D06F 39/08

[52] U.S. Cl. ..... 8/158; 68/12 R; 68/207

[58] Field of Search ..... 8/158; 68/12 R, 207; 307/141, 141.4; 137/387

[56] References Cited

U.S. PATENT DOCUMENTS

| | | | |
|---|---|---|---|
| 3,086,836 | 4/1963 | Ohmann | 8/158 |
| 3,156,115 | 11/1964 | Adelmann | 73/198 |
| 3,478,373 | 11/1969 | McBride | 8/158 |
| 3,478,374 | 11/1969 | McBride | 8/158 |
| 3,498,090 | 3/1970 | Mason | 68/207 |
| 4,201,240 | 5/1980 | Case | 68/207 X |
| 4,303,406 | 12/1981 | Ross | 8/158 |

FOREIGN PATENT DOCUMENTS

| | | | |
|---|---|---|---|
| 2034927 | 6/1980 | United Kingdom | 68/12 R |

*Primary Examiner*—Philip R. Coe

*Attorney, Agent, or Firm*—Hill, Van Santen, Steadman & Simpson

[57] ABSTRACT

An automatic liquid level control is provided for an automatic washing machine which measures the volume of liquid required to be added to the tub to increase the liquid level in the tub by a predetermined increment. The measured amount is compared to a reference amount corresponding to an empty tub. When the measured amount equals the reference amount, the clothes in the washer will be covered and the control terminates introduction of the liquid into the tub and continues with the remainder of the washing cycle.

7 Claims, 6 Drawing Figures

AUTOMATIC LIQUID LEVEL CONTROL FOR AUTOMATIC WASHERS

BACKGROUND OF THE INVENTION

1. Field of the Invention

This invention relates to a washing machine having an automatic liquid level control, and more particularly to a washing machine wherein the correct amount of washing fluid is selected for the requirements of a given load of clothes, automatically and with no pre-selection by an operator.

2. Description of the Prior Art

Various means have been provided for automatically controlling the liquid level in a washing machine. U.S. Pat. No. 3,086,836 discloses an automatic liquid level control wherein a given volume of liquid is added to the clothes load, the volume not absorbed by the clothes load is measured, and that measurement is utilized to determine the additional volume of liquid to be added to obtain the proper total amount of liquid.

U.S. Pat. No. 3,498,090 utilizes a control system for use in an automatic washer to automatically control the quantity of liquid added to the machine's tub during the wash and rinse operations by using a torque signal generated in the machine by action of the agitator.

U.S. Pat. No. 3,478,374 provides for an automatic liquid level control in an automatic washing machine which involves employing a sensing zone in proximity to the axis of the agitator, applying a reduced pressure at the sensing zone, and then introducing additional amounts of liquid into the machine when the liquid has been depleted from the sensing zone as a result of an excessive amount of wash fabric being present in comparison to the amount of washing liquid.

U.S. Pat. No. 3,478,373 provides an automatic liquid level control which responds to the flow of liquid in a predetermined flow path to sense when the proper amount of washing fluid is present in the tub of the washer.

SUMMARY OF THE INVENTION

The present invention operates on the principle that for any given washer and any given wash load there is a measurable quantity of water that will adequately wash that load in that washer. In order to measure the quantity of water needed, there is first established a relationship between the volume of water added to an empty washer to effect equal incremental changes in the depth or level of the wash bath within the wash container. Then the volume depth change relationship is measured during the washer fill process with a wash load in the washer.

The volume-depth relationship for an empty washer may be looked upon as a constant because for each fill the relationship repeats itself over the range of possible wash depths.

However, with a wash load in the washer, the relationship varies because the load displaces some of the incoming fill water, resulting in a smaller volume of water providing the incremental depth changes.

As the depth of the wash bath is increased the wash load becomes increasingly saturated and/or floats. If more water is added after the load is saturated or is floating, there is no additional displacement resulting from the wash load and the volume-depth relationship will coincide with the empty washer relationship.

Even if the load does not totally saturate or float, the volume-depth relationship approaches that of an empty washer.

By comparing the variable volume-depth relationship occuring during the fill period of a washer containing a wash load, with the fixed or constant volume-depth relationship for an empty washer, a wash bath depth can be selected which is adequate to wash the load in that washer.

In accordance with the present invention an automatic liquid level control for an automatic washer is provided wherein the volume of liquid required to be added to a tub charged with clothes to be washed to result in a given incremental increase in the liquid level within the tub is compared with a predetermined value related to the volume of liquid required to be added to the tub to increase the liquid level by the given increment in an uncharged tub.

When there are clothes present in the tub, there will be a lesser volume of liquid required to raise the level of liquid in the tub by the given increment because the clothes occupy part of the volume within the tub which would have been filled with the liquid. When the actual liquid volume added for each additional incremental increase in the liquid level bears an appropriate predetermined relationship to the predetermined value, then a sufficient amount of liquid will have been added to the tub to properly perform the washing functions of the machine.

A flow sensor is used to determine the volume of liquid added during each incremental increase in the liquid level within the tub and a level sensor is utilized to provide a level increment signal. Both of these signals are directed to a microprocessor which compares the values by means of appropriate circuitry to the values which have been experimentally predetermined. When the microprocessor determines that the level of liquid in the tub has reached a sufficient depth for proper washing it sends appropriate signals to the inlet valves to turn off the inflow of liquid and then continues with the remainder of the programmed washing cycle.

DESCRIPTION OF THE PREFERRED EMBODIMENTS

Figure 1:
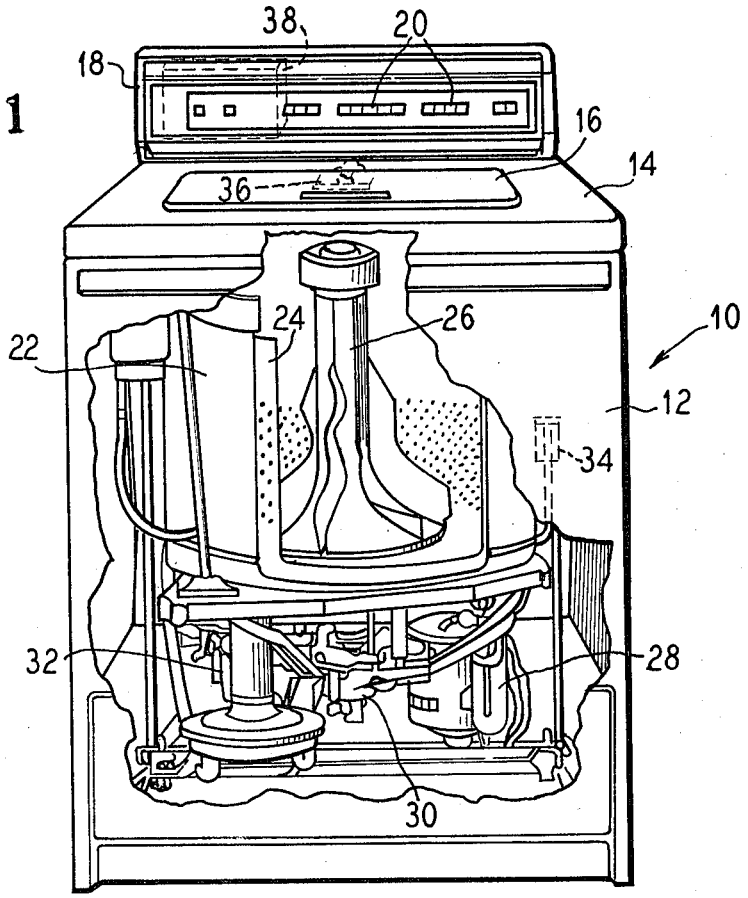
FIG. 1 is a perspective view of a washing machine embodying the present invention partially cut away to show the interior mechanism thereof.

A laundry appliance 10 comprising an automatic clothes washer embodying the principles of the present invention is depicted in FIG. 1. The washer is comprised of a cabinet 12 having a top 14 with an openable lid 16 and a console 18 having presettable controls 20 thereon of the type wherein an operator may pre-select a program of automatic washing, rinsing and centrifuging steps in a laundering process. The lid 16 in the top 14 of the cabinet 12 permits access into the top of a tub 22 housed within the cabinet. Enclosed and supported within the tub 22 is a clothes container or spin basket 24 within which is oscillatably mounted an agitator 26.

Below the tub 22 but within the cabinet 12 there is provided an electrical motor 28 which oscillatably drives the agitator 26 through a transmission 30. The motor 28 also drives a pump 32.

A level sensor 34 is shown in phantom in FIG. 1 and can be similar to the pressure sensitive device described in U.S. Pat. No. 3,086,836. The level sensor 34 is used to determine the incremental changes in the depth of liquid within the tub 22 during the filling portion of the wash cycle. A water inlet including a flow sensor 36 is shown in phantom in FIG. 1 beneath the top 14 of the washer 10. Control circuitry means 38 for sequencing the automatic washer through a plurality of washing, rinsing and centrifuging operations is located within the console 18.

Figure 2:
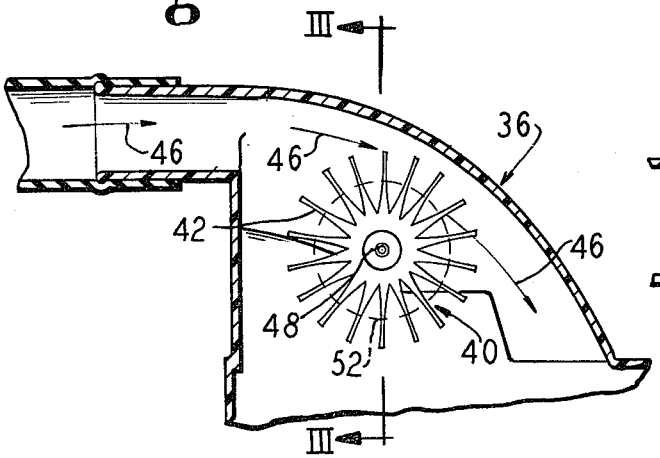
FIG. 2 is an enlarged side sectional view of the flow sensor utilized in the machine of FIG. 1 in connection with the present invention.
Figure 3:
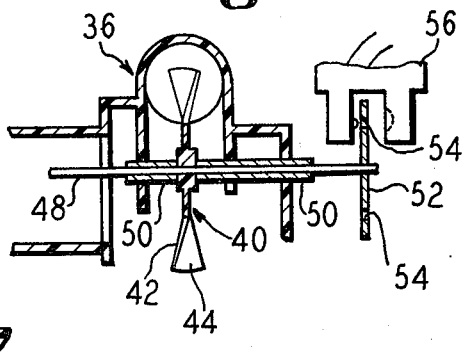
FIG. 3 is a sectional view of the flow sensor taken generally along the lines III—III of FIG. 2.

The flow sensor 36 is shown in greater detail in FIGS. 2 and 3 where it is seen that the flow sensor is comprised of a paddle wheel 40 having radially extending paddle arms 42 with flat blade portions 44 which extend into the incoming flow path of a filling liquid entering the basket 24 through the water inlet as shown by arrows 46. The paddle wheel 40 is mounted on a rotatable axle 48 which is journalled within sleeve bearings 50. A disk 52 is secured to an end of the axle 48 for rotation therewith. In order that the number of revolutions of the paddle wheel 40 can be counted, the disk 52 is provided with a plurality of openings 54 therethrough and a light emitting diode counter 56 is positioned in alignment relative to the holes 54. In this manner, the volume of liquid entering through the liquid inlet can be accurately determined.

The volume of liquid entering the tub is measured and compared with an experimentally predetermined volume required to raise the level of liquid within an empty tub a specific incremental amount from that particular level in the tub. The predetermined value varies between washer models depending on the tub and agitator configurations and within each model it varies depending on the level of liquid in the tub.

Figure 6:
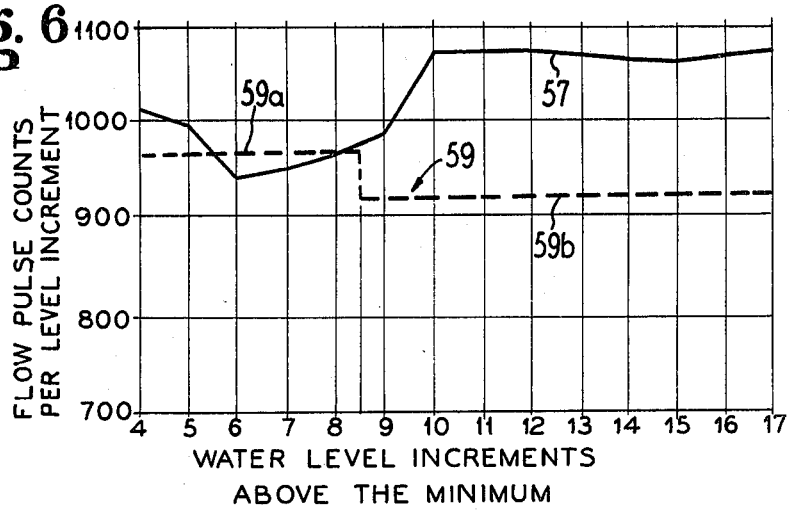
FIG. 6 is a graph showing the experimentally predetermined values for flow pulse counts per level of increment versus liquid level increments above a minimum and the standard against which the microprocessor compares the readings obtained from the flow sensor and the level sensor.

A sample experimentally derived curve 57 is shown in FIG. 6 which is a graph showing the number of flow pulse counts required to change the liquid level equal increments for each increment level above a minimum level in a tub with no clothes in it. If the level of the liquid within the tub is below the top of the clothes load within the tub, the clothes will displace some of the volume normally occupied by liquid when there are no clothes in the tub. Bulky items displace the liquid by their weight and their volume, whereas nonbulky items displace the liquid primarily by their weight. A flow pulse count reading below the number on the experimentally determined curve would mean that the liquid level in the tub has moved from one level increment to the next with less liquid added than if the tub had had no clothes in it. This is an indication that there are still clothes displacing some of the liquid being added. When enough liquid has been added so that none of the clothes are displacing liquid being added to the tub, then the clothes by their weight and volume are displacing all the liquid they can displace. Now, the additional volume of liquid required to increase the liquid level increment by one level should be the same as the experimentally determined value for a tub at the same increment level with no clothes in the tub.

In order to determine whether the required amount of liquid has been added to the tub for the various level increments above the minimum level, a second curve 59 is provided which represents reference values that the microcomputer 72 utilizes in determining the appropriate flow pulse counts required for the various level increments as will be described more fully hereinafter.

Figure 4:
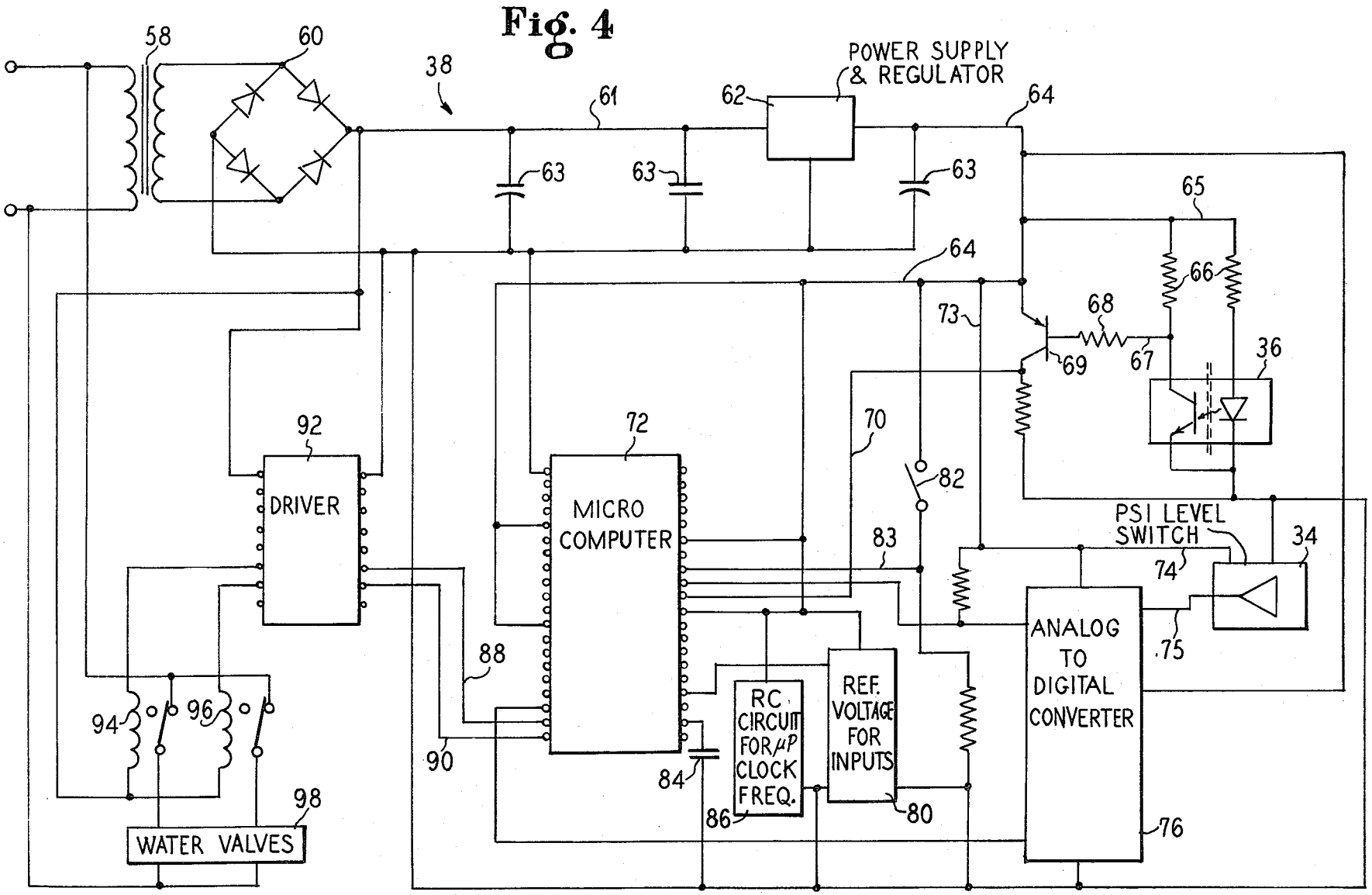
FIG. 4 is a schematic circuit diagram utilized in the present invention.

In FIG. 4 there is shown a portion of the control circuitry means 38 which is utilized for the automatic liquid level control. A transformer 58 in combination with a diode bridge or full wave rectifier 60 converts normal 120 volt/60 cycle household current into the required DC voltage to be utilized in the circuitry. The current flows along line 61 through a voltage regulator 62 which provides for a constant voltage to be utilized in the circuitry. Capacitors 63 are provided to remove voltage spikes in line 61.

Current is supplied to the flow sensor 36 along lines 64 and 65 and through resistors 66. A square wave signal output from the flow sensor 36 is directed along line 67 through a resistor 68 to an amplifier 69 where the signal output of the flow sensor 36 is amplified prior to being directed along line 70 to a microcomputer 72.

Current is supplied to the level sensor 34 along lines 64, 73 and 74. An analog output signal from the level sensor 34 is directed along line 75 through an analog to digital converter 76 where the analog signal is changed to a digital signal. The digital signal is directed to the microcomputer 72 along line 78. Voltage divider circuitry 80 is provided to supply reference voltages for comparison by the microcomputer 72 with the output from the level sensor 34 and the flow sensor 36.

A reset switch 82, being the start switch for the automatic liquid level control, supplies a reset current from line 64 along line 83 to the microcomputer 72. A preset capacitor 84 insures that when power is initially supplied the microcomputer begins the program at the beginning and an RC circuit 86 provides the microcomputer clock frequency.

Output signals from the microcomputer 72 are directed along lines 88 and 90 to a driver amplifier 92 which is used to control relays 94 and 96 which operate inlet water valves 98.

Figure 5:
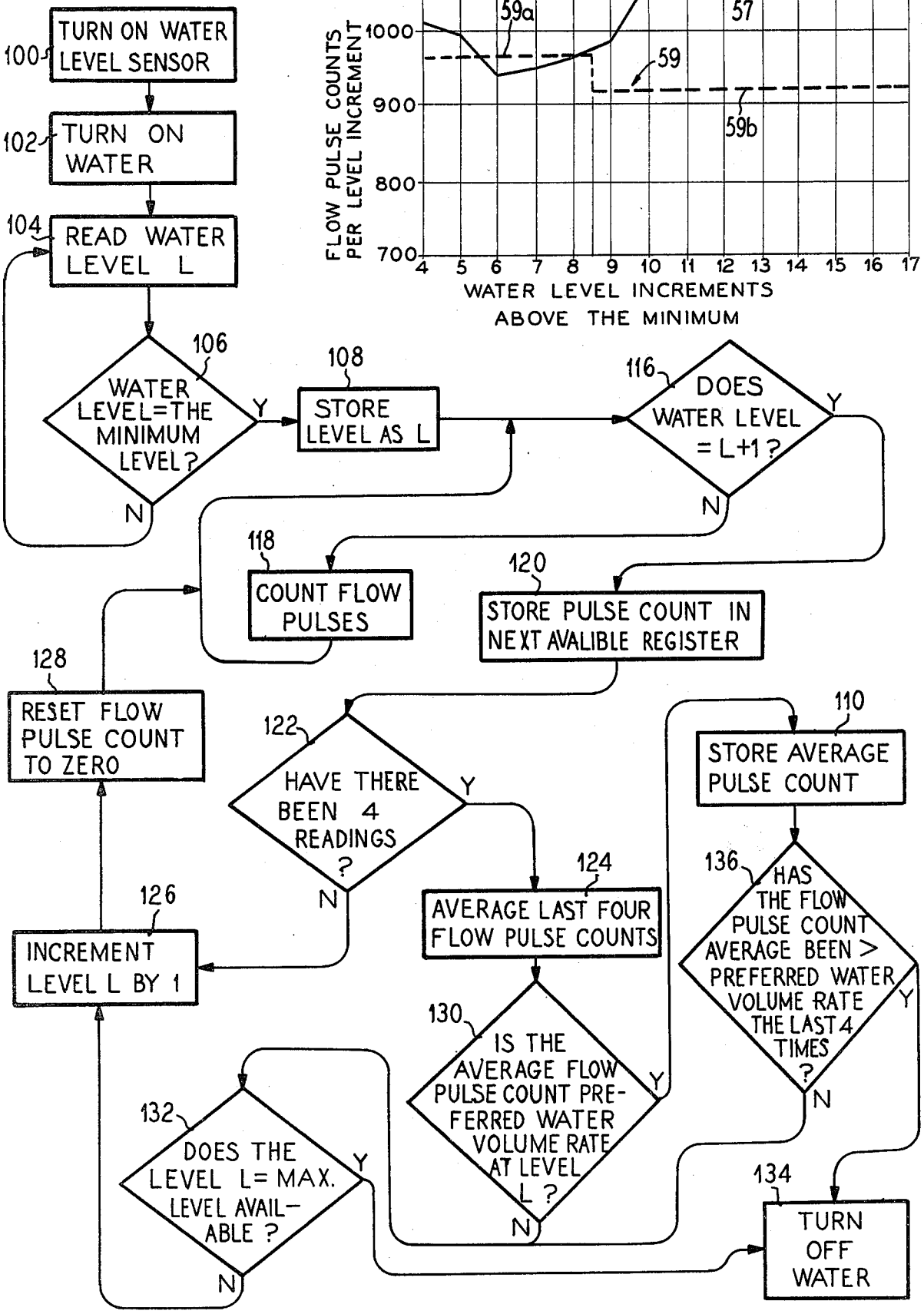
FIG. 5 is a flow chart illustrating operation of an automatic liquid level control process.

FIG. 5 illustrates the operation of the apparatus of the present invention during an automatic cycle of operation. FIG. 5 is in a functional block diagram form, with the various blocks indicating steps performed in sequence during the performance of the method of the present invention, and also indicating the structure which is employed during the operation of the washing machine. Although a preferred embodiment of the present invention employs a controller for the performance of the liquid level controlling program, the present invention also contemplates an organization in which each of the blocks illustrated in FIG. 5 corresponds to an individual control unit. Control of the operation is passed from control unit to control unit, to execute the program in its proper sequence. The operation proceeds by a sequence of steps.

The first step in the performance of the automatic operation of the liquid level control is by control unit 100 which turns on or energizes the level sensor 34. Control then passes to the unit 102 which opens water valves 98 causing liquid to flow into the tub 22. Control is next passed to unit 104 which reads the liquid level within the tub 22 by means of the signal supplied by the level sensor 34. Control passes to a unit 106 which compares the liquid level reading made by unit 104 with a preset minimum liquid level.

If the liquid level is not equal to the minimum level, control is returned to unit 104 so that a new liquid level reading may be taken. This sequence of reading and comparing the liquid level with the minimum level continues until the liquid level equals the preselected minimum level. When unit 106 determines that this has occurred, control is passed to unit 108 which stores the liquid level reading from unit 104 in a memory storage device as level L.

Control is then passed to unit 116 which inspects the output from the level sensor 34 to determine if the current liquid level within the tub 22 is equal to a preselected increment above the level stored by unit 108.

If unit 116 determines that the liquid level has not yet reached the desired increased level, then control is passed to unit 118 which counts the flow pulse signals from the flow sensor 36. Control is returned to unit 116 which again inspects the output signal from the level sensor 34 to determine if the incremental level has been reached. This sequence of checking the level and counting the pulses continues until unit 116 determines that the liquid level in the tub 22 has increased by one increment.

When this is sensed, control passes to unit 120 which stores the pulse count from unit 118 in a memory register. In the preferred embodiment of the invention only four pulse count storage registers are utilized and after four counts have been stored, the earliest count stored is dropped and a new count is placed in that register by unit 120.

Control is passed to unit 122 which determines if there have been four pulse count storage procedures by unit 120. If there have not, control is passed to unit 126 which increments the liquid level value L which was first stored by unit 108 and then control is passed to unit 128 which resets the flow pulse count to zero. Control then passes to unit 116 for an iteration of the process until unit 122 determines that there have been at least four pulse counts stored by unit 120.

When unit 122 has made this determination, control is passed to unit 124 which averages the last four flow pulse counts which have been stored in registers by unit 120. Control then passes to unit 130 which compares the average flow pulse count determined by unit 124 with the predetermined preferred liquid volume rate at level L as shown by curve 59. If unit 130 determines that the average flow pulse count from unit 124 is less than or equal to the preferred count at the stored level, then control is passed to unit 132 which inspects the liquid level L to determine if the current liquid level in the tub is equal to the maximum level allowed.

If the current stored level is below the maximum level, control is passed to unit 126 for iteration of the steps outlined above. If unit 132 determines that the current liquid level is equal to the maximum level allowed in the tub 22 then control is passed to unit 134 which deactivates the water valves 98 to terminate the introduction of liquid into the tub 22.

If unit 130 determines that the average flow pulse count from unit 124 is greater than the preferred pulse count at the current stored level, the control is passed to unit 110 which stores the average pulse count and control passes to unit 136 which determines if each of the last four pulse count averages stored by unit 110 have been greater than the preferred pulse count as indicated by curve 59. If unit 136 determines that they have not, then control is passed to unit 132 to resume the process outlined above. However, if unit 136 determines that each of the last four pulse count averages have been greater than the preferred pulse count then control is passed to unit 134 which terminates introduction of liquid into the tub 22.

Referring back to FIG. 6, it is seen that the reference curve 59 is a step curve having a first higher portion **59*a* between the increment values 4–8 and a second level lower portion 59*b* for the increment 9 through the full level in the tub 22. This stepped curve shows reference values which when compared with the average of the last four flow pulse counts and the individual last four pulse count averages provides for a simplified yet accurate determination allowing for various component and clothes load variations to determine whether the liquid volume entering the tub 22 at the various liquid level increments has approached or equalled the experimentally determined values shown by curve 57**.

Since many loads are not totally displaced during the filling process and do not require enough water to totally displace them for proper washing, the reference curve 59 is selected to provide adequate liquid levels for various size loads.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of automatically charging optimum amounts of liquid in a liquid treatment machine comprising:

(1) placing materials to be treated in a container in the machine;

(2) filling the container to a predetermined minimum level;

(3) measuring the incremental volume of liquid required to increase the liquid level in the container by a specific depth increment;

(4) comparing the measured incremental volume with a predetermined incremental volume for that particular level in the container;

(5) continuing the introduction, measuring and comparison of the incremental liquid volume until the measured volume is greater than the predetermined volume; and (6) terminating the introduction of liquid into said container after said measured volume is greater than the predetermined volume.

2. A method of controlling the amount of liquid supplied to a washing machine tub for washing fabrics during a washing process comprising the steps:

(1) filling the tub with liquid to a selected reference level;

(2) adding a measured amount of liquid to raise the liquid level by a predetermined increment above said reference level;

(3) storing the measured amount;

(4) averaging a given plurality of said stored amounts;
(5) comparing the averaged added amount to a reference quantity for the then current liquid level;
(6) setting the reference level equal to the increased level;
(7) repeating steps (2)–(6) until the averaged added measured amount is greater than the reference quantum a predetermined number of times in succession; and
(8) terminating the introduction of liquid into said tub when said predetermined number of times has occurred.

3. A method of controlling the amount of liquid supplied to a washing machine tub for washing fabrics during a washing process comprising the steps:
(1) filling the tub to a predetermined level;
(2) adding a measured incremental volume of liquid to raise the level within the tub by a predetermined increment;
(3) comparing the measured incremental volume to a predetermined incremental volume for an empty tub at that level;
(4) repeating steps two and three if the measured amount is less than the predetermined amount; and
(5) terminating the filling operation if the measured amount is equal to or greater than the predetermined amount.

4. A method of controlling the amount of liquid supplied to a washing machine tub for washing fabrics during a washing process comprising the steps:
(1) filling the tub to a predetermined level;
(2) adding a measured incremental volume of liquid to raise the level within the tub by a predetermined increment;
(3) comparing the measured incremental volume to a predetermined incremental volume for an empty tub at that level;
(4) repeating steps two and three until the measured amount has been greater than the predetermined amount a predetermined number of times; and
(5) terminating the filling operation when the predetermined number of times has been achieved in uninterrupted succession.

5. The method of claim 1 wherein said comparing is performed by microcomputer means.

6. The method of claim 1 wherein said measuring is performed by a flow responsive counting device positioned in a liquid input flow path.

7. A method of controlling the amount of liquid supplied to a washing machine tub for washing fabrics during a washing process comprising the steps:
(1) filling the tub to a predetermined level;
(2) adding a measured incremental volume of liquid to raise the level within the tub by a predetermined increment;
(3) comparing the measured incremental volume to a predetermined incremental volume for an empty tub at that level;
(4) repeating steps two and three until the measured and predetermined amounts achieve a predetermined relationship; and
(5) terminating the filling operation when said predetermined relationship is achieved.

* * * * *